US012495940B1

(12) United States Patent
Basile

(10) Patent No.: US 12,495,940 B1
(45) Date of Patent: Dec. 16, 2025

(54) REMOVABLE TOILET BOWL COVER APPARATUS

(71) Applicant: Anabela Basile, Springfield, MA (US)

(72) Inventor: Anabela Basile, Springfield, MA (US)

( * ) Notice: Subject to any disclaimer, the term of this patent is extended or adjusted under 35 U.S.C. 154(b) by 0 days.

(21) Appl. No.: 19/308,892

(22) Filed: Aug. 25, 2025

Related U.S. Application Data

(63) Continuation of application No. 19/206,787, filed on May 13, 2025.

(51) Int. Cl.
*A47K 13/14* (2006.01)

(52) U.S. Cl.
CPC ..... *A47K 13/14* (2013.01)

(58) Field of Classification Search
CPC ..... A47K 13/14
USPC ..... 4/254.1
See application file for complete search history.

(56) References Cited

U.S. PATENT DOCUMENTS

| | | | | |
|---|---|---|---|---|
| 2,260,404 A | | 10/1941 | Richardi | |
| 2,529,587 A | * | 11/1950 | Bates | E03D 11/00 4/253 |
| 2,617,996 A | | 11/1952 | Hoffman et al. | |
| 2,728,921 A | | 1/1956 | Dorko | |
| 3,346,888 A | * | 10/1967 | Paysinger | A47K 13/24 4/253 |
| 4,348,776 A | | 9/1982 | Sarjeant | |
| 5,067,185 A | | 11/1991 | Kohler | |
| D521,619 S | | 5/2006 | Salyers | |
| 7,047,573 B2 | * | 5/2006 | Young | A47K 13/06 4/239 |
| 8,104,102 B2 | * | 1/2012 | O'Hanley | E03D 9/00 4/255.11 |
| 8,209,787 B2 | | 7/2012 | Rosswaag | |
| 11,162,252 B2 | * | 11/2021 | Park | E03D 11/00 |
| 11,406,233 B2 | | 8/2022 | Painter | |
| 11,406,234 B1 | | 8/2022 | Cadogan | |
| 2003/0024038 A1 | * | 2/2003 | Cross | A47K 13/24 4/253 |
| 2006/0053541 A1 | | 3/2006 | Howard | |

(Continued)

FOREIGN PATENT DOCUMENTS

| | | | |
|---|---|---|---|
| GB | 2556862 | A | 6/2018 |
| WO | 2021142523 | A1 | 7/2021 |

OTHER PUBLICATIONS

International Search Report and Written Opinion; PCT/US2025/042776; Mailed Nov. 4, 2025.

*Primary Examiner* — Huyen D Le
(74) *Attorney, Agent, or Firm* — Dunlap Bennett & Ludwig, PLLC; Jeff A. Burke

(57) ABSTRACT

A removable toilet bowl cover apparatus designed to enhance sanitation and pest control in bathroom environments. The apparatus includes a flexible, snap-on cover configured to overlay a toilet seat, featuring a top rim, a center body, and a side rim that defines an opening for receiving the toilet bowl. Ergonomic handle grips are integrated into the side rim to facilitate easy attachment and removal. The center body incorporates ventilation holes to allow air circulation while reducing moisture buildup. The cover is constructed from durable, flexible materials with antimicrobial and disinfecting coatings to inhibit bacterial growth and odors. This apparatus provides a secure, user-friendly solution for maintaining hygiene and preventing pest access in residential and commercial bathrooms.

2 Claims, 3 Drawing Sheets

(56) References Cited

U.S. PATENT DOCUMENTS

| | | | |
|---|---|---|---|
| 2008/0256694 | A1 | 10/2008 | Wilbarger |
| 2009/0049591 | A1 | 2/2009 | Orona, Jr. |
| 2012/0278982 | A1 | 11/2012 | Rogers |
| 2014/0013497 | A1 | 1/2014 | Mitchell et al. |
| 2014/0317837 | A1 | 10/2014 | Chien et al. |
| 2016/0237669 | A1 | 8/2016 | Mullens |
| 2022/0395148 | A1 | 12/2022 | Stern |
| 2023/0225573 | A1 | 7/2023 | Guzman |
| 2024/0215776 | A1 | 7/2024 | Adams |

* cited by examiner

REMOVABLE TOILET BOWL COVER APPARATUS

CROSS-REFERENCE TO RELATED APPLICATIONS

This application is a continuation of application Ser. No. 19/206,787, filed May 13, 2025, the contents of which are herein incorporated by reference.

BACKGROUND OF THE INVENTION

Field of Endeavor

The present disclosure pertains to mechanical devices aimed at enhancing sanitation and pest control, particularly removable toilet seat covers designed to restrict access by insects and rodents.

Background of Related Art

The field of this disclosure encompasses advancements in sanitation measures and pest control systems within residential and commercial bathroom environments. In settings where maintaining high standards of hygiene is a priority, there is an ongoing challenge to prevent contaminant exposure, particularly from insects and rodents. Over time, numerous solutions have been introduced to address issues related to unsanitary conditions, yet the overarching goal remains to improve bathroom hygiene while facilitating ease of maintenance. Users and facility managers alike have a vested interest in systems that not only provide protective measures but also integrate smoothly into daily routines without introducing unnecessary complexity.

Innovators in this area have long pursued solutions that balance functionality with convenience. There is a strong demand for products that provide a dependable barrier during periods of non-use, ensuring that hygiene is not compromised. The goals commonly associated with these sanitation products include ease of installation, secure performance, and a design that facilitates routine cleaning and upkeep. In environments with diverse user needs—from public restrooms to private households—maintaining a secure and hygienic toilet facility remains a significant focus, driving the ongoing search for effective, user-friendly solutions.

Review of available devices indicates that many current solutions face challenges related to size, installation complexity, and consistent performance. Numerous systems intended to safeguard against unwanted access have been found to be cumbersome or unable to form a reliable barrier, leading to inadvertent exposure to environmental contaminants. In many cases, these devices do not adequately adapt to variations in fixture design, leading to gaps or inconsistencies in protection. Such shortcomings underscore the difficulty of achieving an optimal balance between secure installation and convenient operation, posing a challenge to both users and manufacturers.

Specific issues observed in existing sanitation devices include difficulties with maintaining a continuous, secure seal and the need for frequent adjustments to ensure proper functionality. Users have encountered problems with devices that may become dislodged during routine use, leading to periods of vulnerability where contaminants can gain access. Additionally, concerns about material durability and the ease of cleaning have been repeatedly noted. These user experiences highlight a need for a more refined approach that addresses these significant challenges while providing a solution that is both robust in performance and straightforward in everyday application.

SUMMARY OF THE INVENTION

In one embodiment, the disclosure provides a removable toilet bowl cover apparatus comprising a flexible, snap-on cover designed to overlay a toilet seat. The cover includes a top rim, a center body, and a side rim that defines an opening for receiving a toilet bowl. A handle grip is configured on the side rim to facilitate attachment to and removal from the toilet seat, and a plurality of ventilation holes formed in the center body allow air circulation.

In another embodiment, the apparatus further includes at least one coating applied to an exterior surface of the snap-on cover, the coating exhibiting one or more properties selected from antimicrobial and disinfecting effects.

DETAILED DESCRIPTION OF THE INVENTION

Figure 1:
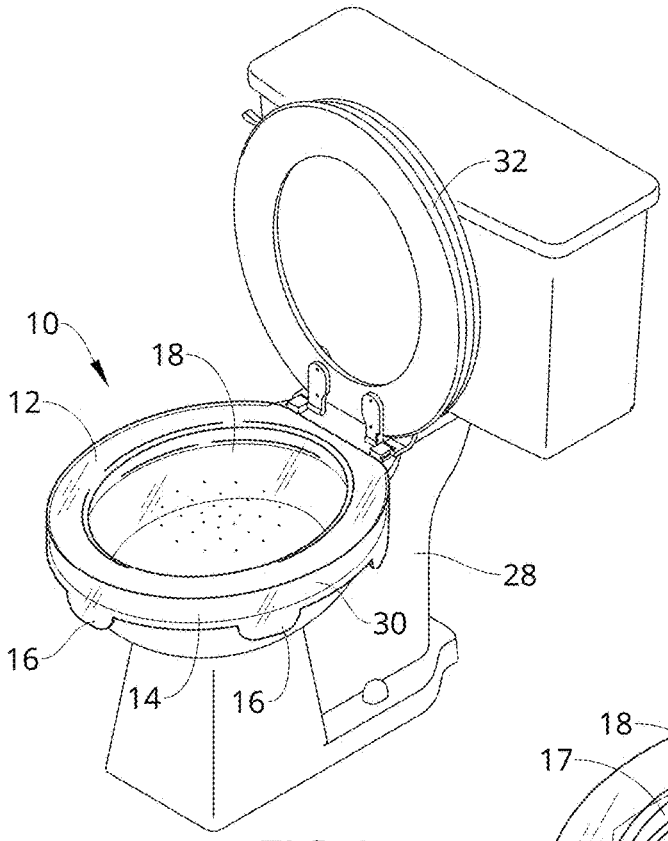
FIG. 1 is a perspective view illustrating the removable toilet bowl cover apparatus installed on a toilet assembly.
Figure 2:
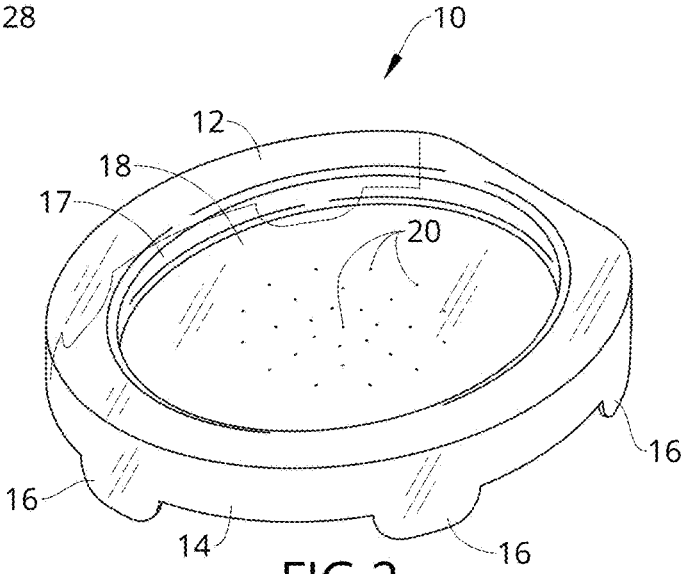
FIG. 2 is a perspective view illustrating the removable toilet bowl cover apparatus, highlighting the structural configuration and primary components of the apparatus.
Figure 3:
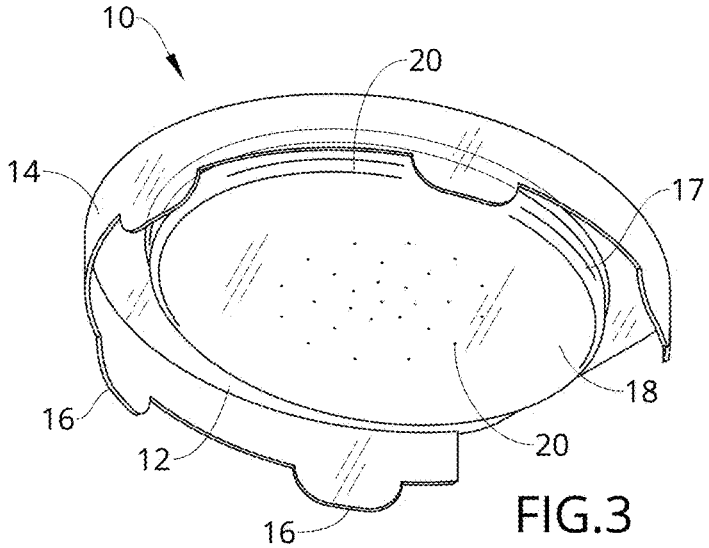
FIG. 3 is a perspective view illustrating the structural configuration of the removable toilet bowl cover apparatus.
Figure 4:
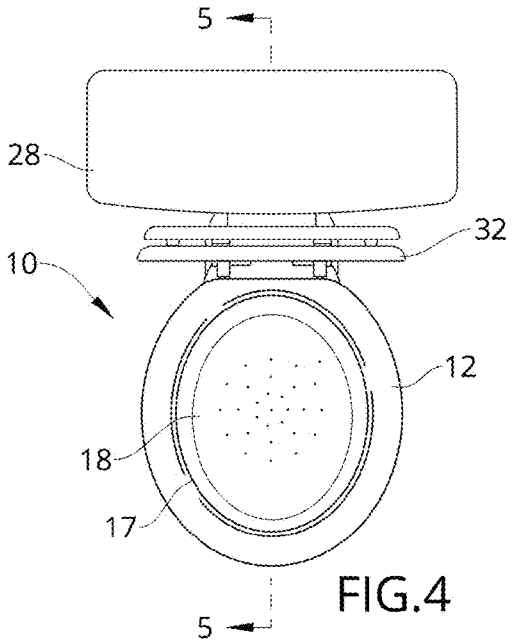
FIG. 4 is a schematic diagram illustrating the removable toilet bowl cover apparatus in the installed configuration over a toilet seat.
Figure 5:
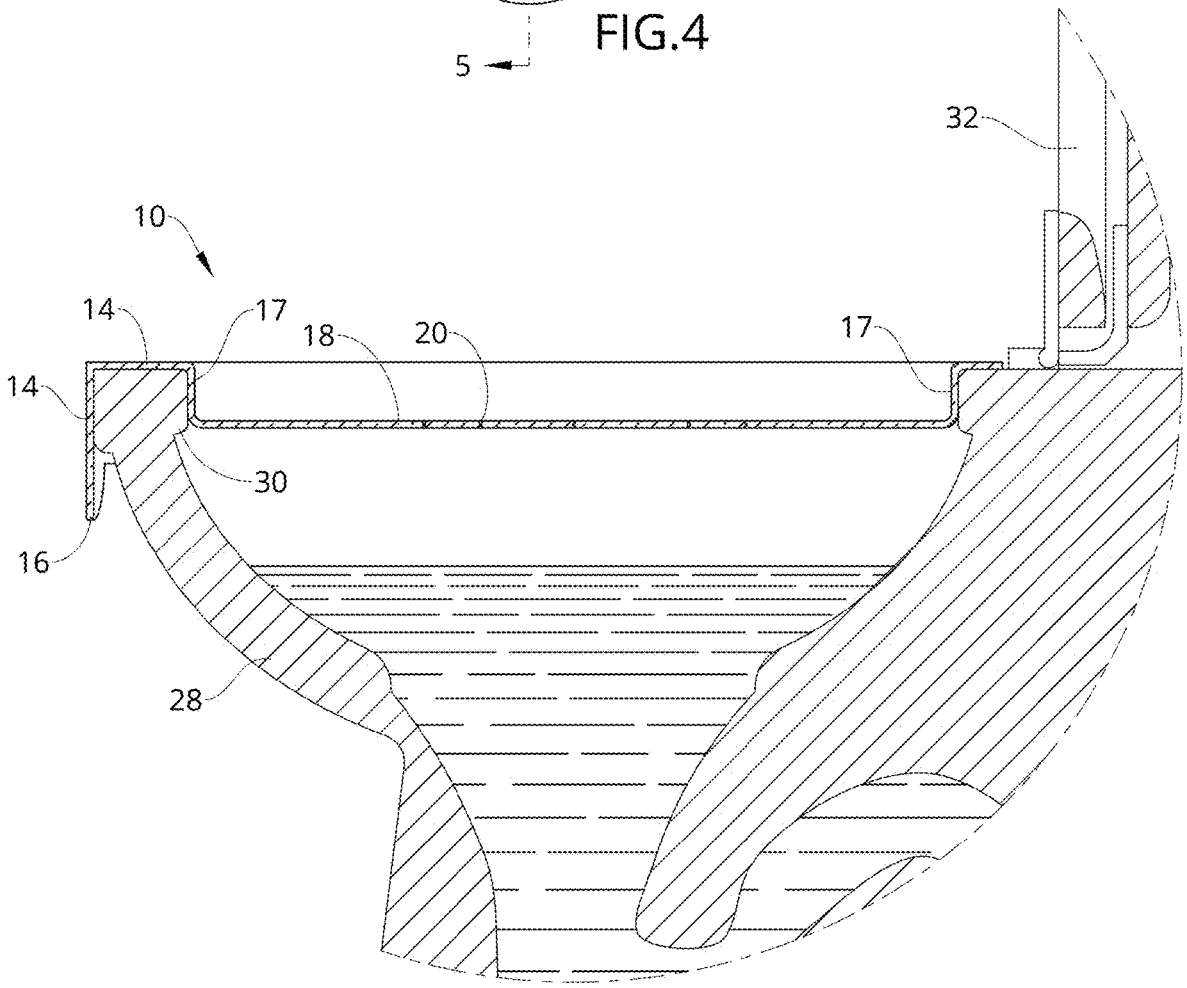
FIG. 5 is a cross-sectional system diagram illustrating the removable toilet bowl cover apparatus in the installed position over a toilet bowl, taken along line 5-5 of FIG. 4.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

The problem addressed by the present disclosure lies in the persistent challenge of maintaining sanitary conditions in bathroom environments, particularly in preventing exposure to insects and rodents when a toilet is not in use. Existing solutions, such as traditional toilet seat covers, often fail to provide a secure and effective barrier, leaving gaps that allow pests to infiltrate the toilet area. These devices are frequently bulky, difficult to install, or incompatible with varying toilet designs, resulting in inconsistent performance. Additionally, many conventional covers are made from materials that are not optimized for hygiene, leading to bacterial growth, odor accumulation, and increased maintenance requirements. These shortcomings highlight the need for a more reliable, user-friendly solution that addresses both pest control and sanitation concerns.

The present disclosure improves upon prior approaches by introducing a soft, snap-on toilet seat cover that securely fits over the toilet seat, creating a reliable barrier against pests while promoting improved hygiene. Unlike traditional covers, the described design features a snug, coffee cup lid-like fit that adapts to various toilet shapes and sizes, ensuring a consistent seal without gaps. The inclusion of a sealing gasket further enhances the airtight fit, preventing any access for insects or rodents. The cover is constructed from durable, flexible materials treated with a hygienic antimicrobial coating, which inhibits bacterial growth and odor formation, thereby reducing the need for frequent cleaning or replacement.

The described apparatus also incorporates user-friendly features, such as an ergonomic handle grip for straightforward attachment and removal, and strategically placed ventilation holes that allow air circulation while reducing moisture buildup. These design elements work together to provide a solution that is both functional and convenient, addressing the limitations of existing devices. By combining pest control, sanitation, and ease of use, the described system represents a notable improvement in bathroom hygiene apparatuses, promoting a cleaner and safer environment for users.

FIG. 1-6 illustrate aspects of a Toilet Bowl Cover Apparatus 10, according to aspects of the present invention. Apparatus 10 is manufactured of flexible materials, such as plastics, rubbers, flexible metals, etc., and which can be monolithically formed, molded, cast, etc., utilizing known manufacturing techniques. In embodiments, Apparatus 10 is manufactured in varying sizes and shapes to accommodate varying sizes and shapes of toilet bowl rims, such as toilet bowl rim 30. In embodiments, apparatus 10 is monolithically formed having a plurality of curves, bends, etc., which define one or more surfaces, landmarks, or structures of the present invention, such as top rim 12, side rim 14, handles 16, lip 17, and center body 18.

Center body 18 forms the base of apparatus 10 and is configured to prevent intrusion of pest into toilets, such as toilet 28, while allowing air flow for sanitary reasons. In embodiments, center body 18 is shaped to conform with a shape of the rim of the toilet on which it is set, and can be manufactured in various shapes and sizes. In embodiments, center body 18 includes a plurality of surfaces including at least an outer surface and an inner surface, wherein the inner surface faces the inside of the bowl of toilet 28, when installed thereon. In embodiments, center body 18 can be transparent thereby allowing a user to visually inspect the bowl of toilet 28, without the need to remove apparatus 10. In embodiments, center body 18 includes a plurality of apertures, or vent holes 20, disposed from an outer surface through to an inner surface of center body 18. In embodiments, vent holes 20 are configured to allow air circulation while preventing pest access, thereby ensuring that no moisture and/or odors build up within toilet 28.

Lip 17 is continuously affixed to center body 18 with the transition from center body 18 to lip 17 being defined by a bend or curve. In embodiments, the bend can be substantially at a right angle, i.e. 90°, but is not so limited. Lip 17 can be orthogonal to center body 18, but is not so limited, as lip 17 is configured to contact an inner surface of toilet bowl rim 30, and can be shaped, sloped, or otherwise configured to maintain contact therewith.

Top rim 12 is continuously affixed to lip 17 with the transition from lip 17 to top rim 12 being defined by a bend or a curve. In embodiments, the bend can be substantially at a right angle, i.e. 90°, but is not so limited. Top rim 12 can be orthogonal to center body 18, but is not so limited, as top rim 12 is configured to contact an upper surface of toilet bowl rim 30, and can be shaped, sloped, or otherwise configured to maintain contact therewith.

Side rim 14 is continuously affixed to top rim 12 with the transition from top rim 12 to side rim 14 being defined by a bend or a curve. In embodiments, the bend can be substantially at a right angle, i.e. 90°, but is not so limited. Side rim 14 can be orthogonal to top rim 12, but is not so limited, as side rim 14 is configured to contact an outer surface of toilet bowl rim 30, and can be shaped, sloped, or otherwise configured to maintain contact therewith. The structure formed by the interconnection of lip 17, top rim 12, and side rim 14 form a channel with is configured to fit securely over toilet bowl rim 30 forming a "coffee-lid" like fit over toilet bowl rim 30.

Figure 6:
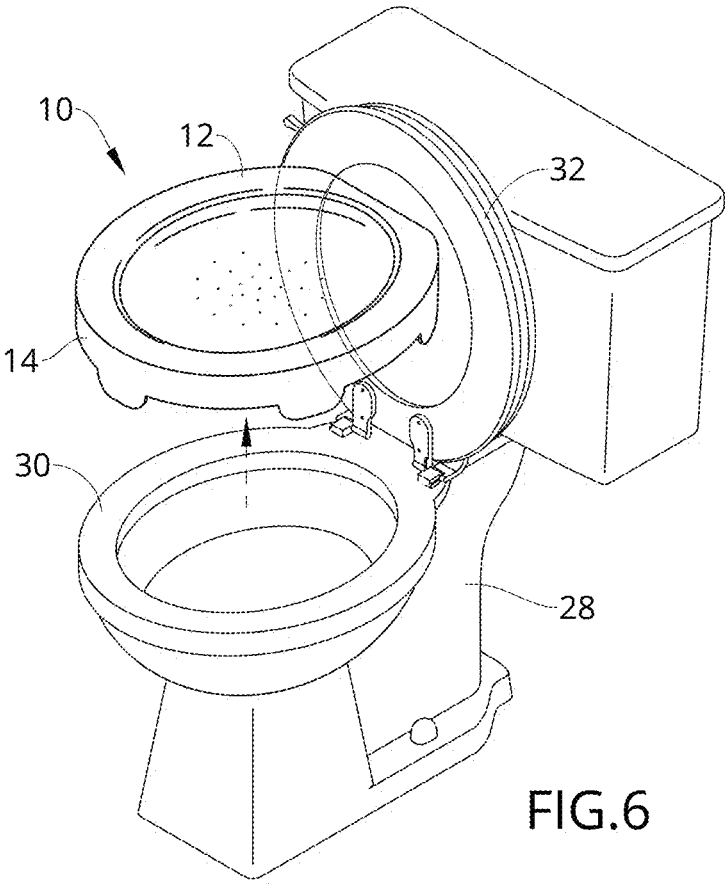
FIG. 6 illustrates a perspective view of the removable toilet bowl cover apparatus installed on a toilet assembly.

Handles 16 are integrated into the side rim 14 to facilitate user interaction with the apparatus. These ergonomic handles 16 allow for easy placement and removal of the cover assembly 10 without compromising the integrity of the seal. The handles 16 enhance user convenience, making the apparatus suitable for both residential and commercial bathroom environments. In embodiments, a user can grip one or more of the handles 16 and pull the one or more gripped handles outward, away from central body 18, while pulling apparatus 10 away from toilet seat 32, as illustrated in FIG. 6.

In embodiments, apparatus 10 can be treated with one or more treatments to prevent one or more unhygienic conditions. For example, all surfaces of apparatus 10 can include one or more treatments, such as antimicrobial treatments, antibacterial treatments, anti-odor treatments, and/or disinfecting treatments. Additionally, one or more seals, such as an O-ring, gasket, etc., can be provided with apparatus 10, and can be disposed in the channel formed by lip 17, top rim 12, and side rim 14. The one or more seals are configured to provide a secure seal with apparatus 10 disposed over toilet 28. In embodiments, the one or more seals can be formed of soft rubber, and/or other wear resistant materials.

A method of using apparatus 10 is also provided herewith. In embodiments, the method can begin with cleaning of toilet 28, wherein once toilet 28 is cleaned it is allowed to dry for a period of time to allow for proper adhesion of apparatus 10. Once dry, a gasket is installed on toilet bowl rim 30 to ensure a proper seal of apparatus 10. Once the gasket is installed, apparatus 10 is aligned to toilet bowl rim 30 and pressed onto toilet bowl rim 30, wherein an airtight seal is formed between apparatus 10, the gasket, and toilet bowl rim 30. Once installed, apparatus 10 prevents introduction of pests, while allowing airflow, thereby maintaining sanitary conditions for toilet 28 during periods of non-use. Optionally, to remove apparatus 10 the user can grip one or more of handles 16 and pull away from toilet bowl rim 30. By pulling away from rim 30, apparatus 10 is flexed thereby breaking the airtight seal and allowing the user to pull apparatus up and away from rim 30.

It should be understood, of course, that the foregoing relates to exemplary embodiments of the invention and that modifications may be made without departing from the spirit and scope of the invention as set forth in the following claims.

What is claimed is:

1. A removable toilet bowl cover apparatus, comprising:

a flexible snap-on cover monolithically formed configured to overlay a toilet seat, the cover having a top rim, a center body, and a side rim defining an opening for receiving the toilet bowl;

at least one handle grip monolithically formed on the side rim configured to facilitate attachment to and removal from the toilet seat; and a plurality of ventilation holes formed through the center body and configured to permit air circulation.

2. The removable toilet bowl cover apparatus of claim 1, further comprising:

at least one coating applied to an exterior surface of the snap-on cover, the at least one coating having one or more of: an antimicrobial property, or a disinfecting property.

* * * * *